US008074447B2

(12) United States Patent
Scherer et al.

(10) Patent No.: US 8,074,447 B2
(45) Date of Patent: Dec. 13, 2011

(54) PROCEDURE TO DETERMINE THE SULFUR REMOVAL OF $NO_x$ STORAGE CATALYTIC CONVERTER

(75) Inventors: Stefan Scherer, Stuttgart (DE); Simone Neuberth, Walzbachtal (DE); Christian Covini, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 886 days.

(21) Appl. No.: 11/880,959

(22) Filed: Jul. 24, 2007

(65) Prior Publication Data

US 2008/0022667 A1 Jan. 31, 2008

(30) Foreign Application Priority Data

Jul. 31, 2006 (DE) ..... 10 2006 035 283

(51) Int. Cl.
*F01N 3/00* (2006.01)
*F01N 3/10* (2006.01)
*F02B 27/04* (2006.01)

(52) U.S. Cl. ..... 60/295; 60/273; 60/286; 60/301

(58) Field of Classification Search ..... 60/295, 60/273

See application file for complete search history.

(56) References Cited

U.S. PATENT DOCUMENTS 7,197,867 B2 * 4/2007 Huang et al. ..... 60/295
2004/0050037 A1 * 3/2004 Betta et al. ..... 60/286
2005/0223698 A1 * 10/2005 Murata et al. ..... 60/286

* cited by examiner

*Primary Examiner* — Thomas Denion
*Assistant Examiner* — Michael Carton
(74) *Attorney, Agent, or Firm* — Merchant & Gould P.C.

(57) ABSTRACT

The invention concerns a procedure to determine the sulfur removal of a $NO_x$ storage catalytic converter in an exhaust gas aftertreatment system of an internal combustion engine, whereby conditions, in which a surplus of the reducing agent is generated in the internal combustion engine, are adjusted in the internal combustion engine for the sulfur removal, whereby a $SO_x$ removal amount is determined in a $SO_x$ removal calculation using a model from the reducing agent flow and from additional operating parameters of the internal combustion engine. In so doing, dynamic effects during the desulferization of the $NO_x$ storage catalytic converter can be better taken into account for the $SO_x$ removal calculation; and in so doing, the subsequent effect of the $NO_x$ storage catalytic converter on the reduction of the nitrogen oxides in the exhaust gas can be more accurately predicted, which makes the process management more streamlined and consequently more fuel efficient.

5 Claims, 1 Drawing Sheet

PROCEDURE TO DETERMINE THE SULFUR REMOVAL OF $NO_x$ STORAGE CATALYTIC CONVERTER

Figure 1:
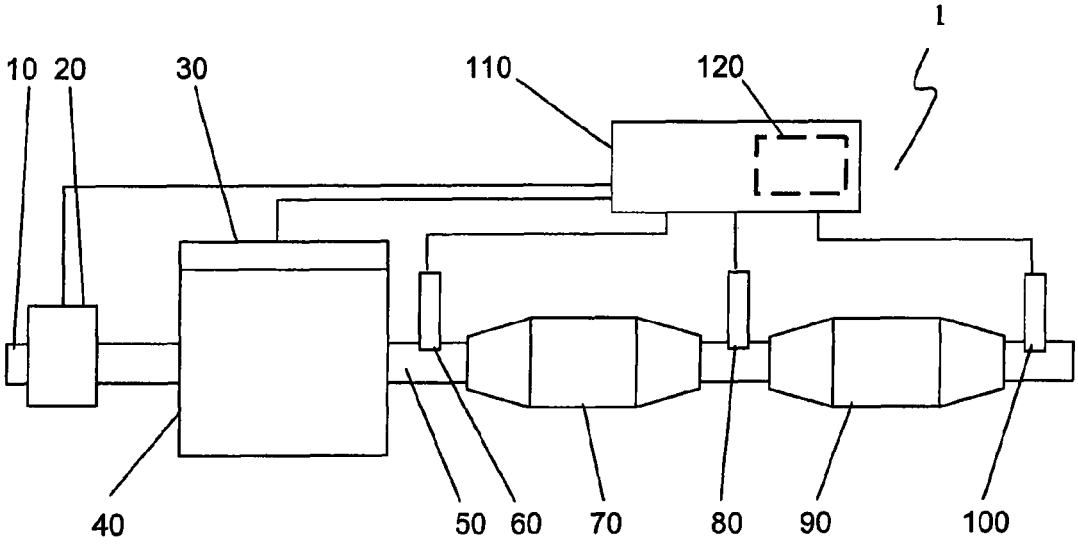

The invention concerns a procedure to determine the sulfur removal of a $NO_x$ storage catalytic converter in an exhaust gas aftertreatment system of an internal combustion engine, whereby conditions, in which a surplus of the reducing agent is generated in the internal combustion engine, are adjusted in the internal combustion engine for the sulfur removal.

In the case of diesel engines, combined exhaust gas aftertreatment systems with particle filters (DPF) and $NO_x$ storage catalytic converters (NSC), for example, are increasingly being planned, respectively already deployed, due to the demands with regard to the lower emission threshold values. Particle filters have, however, a limited storage capability and must be regenerated in certain intervals to restore the purifying effect. This occurs typically every 250 to 1000 km; whereby by means of steps in the fuel-mixture generation of the engine or by means of steps in the exhaust system of the engine, the regeneration is initiated by an increase in the exhaust gas temperature to typically 550° C. to 650° C. In so doing, an exothermic reaction is set into motion, which causes a burnout of the sooty particles and regenerates the particle filter within a short time (for example 20 minutes).

When operating an $NO_x$ storage catalytic converter in the exhaust gas assembly of an internal combustion engine, this catalytic converter stores the nitrogen oxide contained in the exhaust gas completely or at least partially so long as an oxygen surplus, i.e. a lean operation with a Lambda value of $\lambda>1$, prevails in the exhaust gas. Furthermore, the storage characteristic still depends on additional operational parameters, such as temperature of the storage material, the exhaust gas volume flow and the fill level of the storage unit. Moreover, the capability to store nitrogen oxides is dependent on a depletion process, which is caused for the most part by high operating temperatures.

The nitrogen oxides stored by the $NO_x$ storage catalytic converter during the lean operation of the engine are released during the so-called regeneration process from the storage material and converted with a suitable reducing agent to nitrogen. For that purpose the internal combustion engine is operated for a short time with a fuel surplus, or a reducing agent is metered into the direction of flow of the exhaust gas in front of the $NO_x$ storage catalytic converter. Such a regeneration must normally be implemented after the expiration of a few minutes.

Beside the characteristic of binding the nitrogen oxides from the lean exhaust gas, the storage material also absorbs the sulfur oxides ($SO_x$) contained in the exhaust gas. Depending on the sulfur content of the fuel and motor oil used, a differing amount of sulfur will in the process be embedded in the $NO_x$ storage catalytic converter. This sulfur reduces the number of $NO_x$ storage locations in the catalytic converter and reduces for that reason the efficiency of the $NO_x$ storage catalytic converter (NSC). A sulfur poisoning of the $NO_x$ storage catalytic converter is also referred to in this connection. At the temperatures of approximately 200 to 600° C. normally prevailing during the $NO_x$ regeneration process described above, success in breaking the bonds of the sulfur to the storage material is, however, not achieved.

As a result, such a great amount of sulfur collects in the storage material from the combustion of fuel and motor oil, even when the engine is operating with fuel especially lean in sulfur (typically 10 ppm); so that the exhaust gas aftertreatment system does not achieve anymore the nitrogen oxide conversions required to maintain the emission threshold values. For this reason, a desulfurization (=$DeSO_x$) of the $NO_x$ storage catalytic converter must be regularly implemented, in order to counteract the deterioration of the $No_x$ storage capability connected with the problem.

When using the fuel lean in sulfur (10 ppm), the decreasing conversion of the NSC requires such a $DeSO_x$ approximately every 2000 to 5000 km. In so doing, the exhaust gas system, like in the case of the particle filter regeneration, is likewise heated up to a high temperature level, which in this case typically lies between 600 and 800° C. in the $NO_x$ storage catalytic converter. Additionally after achieving this temperature level by means of phases with a rich exhaust gas mixture ($\lambda \leqq 1$), i.e. with a surplus of CO/HC and $H_2$ with regard to $O_2$, conditions are created, in which the sulfur can be discharged from the $NO_x$ storage catalytic converter. In so doing, the sulfur bonds are broken in the storage material and the sulfur compounds, for example in the form of sulfur dioxide ($SO_2$), carbonyl sulfide (COS) and/or hydrogen sulfide ($H_2S$) are discharged. Among the aforementioned compounds, only the sulfur dioxide ($SO_2$) is, however, acceptable as an emission. For that reason, either the exhaust gas composition during the regeneration operation must be suitably composed, or the process management must include a suitable time control in order to avoid in particular the release of hydrogen sulfide.

The problem exists in practice during the process management that by the non-stationary operation of the motor, respectively by changing driving conditions, the conditions especially with regard to the following items are never constant.

- the composition of the reducing agent in the rich gas mixture
- the temperature of the $NO_x$ storage catalytic converter and exhaust gas mass flow When the desulfurization process is purely time controlled, a complete discharge of the sulfur out of the $NO_x$ storage catalytic converter is accepted after a certain minimum processing time. When the process is prematurely cancelled, a partial sulfur discharge can, in fact, be calculated, which, however, in the case of a pure time control according to the State of the Art is only sufficiently accurate when stationary operating conditions of the engine exist.

For this reason, it is the task of the invention to provide a procedure to determine the sulfur removal of a $NO_x$ storage catalytic converter, in order to be better able to assess the effect of the sulfur discharge released by the desulfurization process during these non-stationary conditions.

The task of the invention is thereby solved, in that in a $SO_x$ removal calculation, a $SO_x$ removal amount is determined using a model from the reducing agent flow and from additional operating parameters of the internal combustion engine. With this procedure dynamic effects during a desulfurization of the $NO_x$ storage catalytic converter can be better taken into account. In so doing, the subsequent effect of the $NO_x$ storage catalytic converter on the reduction of the nitrogen oxides in the exhaust gas can more accurately be predicted, which makes the process management more streamlined and thereby more fuel efficient.

If the reducing agent flow in the exhaust gas during the sulfur removal is determined from a reducing agent characteristic diagram, which is constructed from the operational state, from an engine rotational speed and from a torque of the internal combustion engine, the advantage results, in that the reducing agent flow, which is necessary for the desulfurization, is very accurately predictable. Already in this instance, dynamic conditions with regard to the determination of the reducing agent flow can be taken into account.

A certain Lambda value must be set with regard to the operating conditions for the desulfurization process. When the set points for the Lambda value or during the dynamic operation are not achieved, it can occur that a larger or smaller reducing agent flow is generated in the exhaust gas, which would distort the sulfur discharge calculation. For this reason, it is advantageous if the reducing agent flow is corrected with a Lambda correction, which is calculated from a deviation from the set point Lambda value and an actual Lambda value.

With regard to an avoidance of hydrogen sulfide, provision is made in a preferred procedural variation for the reducing agent flow corrected with the Lambda correction to be integrated; and when a specifiable reducing agent threshold value has been achieved, provision is made for the operating conditions generating the reducing agent flow in the exhaust gas to be terminated after a specifiable time.

The releasing of the chemical bond of the sulfur to the storage material is a markedly temperature dependent reaction, so that it is especially advantageous if the reducing agent flow is corrected with a temperature correction, which is calculated from the temperature of the $NO_x$ storage catalytic converter. In so doing, especially the temperature dependent efficiency of the desulfurization can accordingly be taken into account.

Provision is made additionally in a procedural variation for the temperature correction to be determined, in that the desulfurization is implemented repeatedly at different temperatures and the effect is compared. Effects due to depletion can also thereby be recognized and correspondingly adapted.

At the beginning of a desulfurization process, the reducing agent in the $NO_x$ storage catalytic converter encounters initially large amounts of superficially accumulated sulfur components. In the ensuing progression of the process, the reducing agent must penetrate deeper into the storage material in order to encounter additional sulfur bonds. For this reason the magnitude of the sulfur discharge chronologically tapers off exponentially, although all of the other operating parameters, as they have already been described above, remain the same. In order to reproduce these properties as a model, it is advantageous if the reducing agent flow is corrected with a $DeSO_x$ progression correction regarding the desulfurization process, which is proportionally calculated from the time period for the desulfurization.

Provision is made in an advantageous procedural variation for the $SO_x$ sulfur removal calculation to be implemented as software in an engine control unit. In so doing, very flexible changes in the calculation strategy of the sulfur discharge can be implemented by corresponding software updates.

Figure 2:
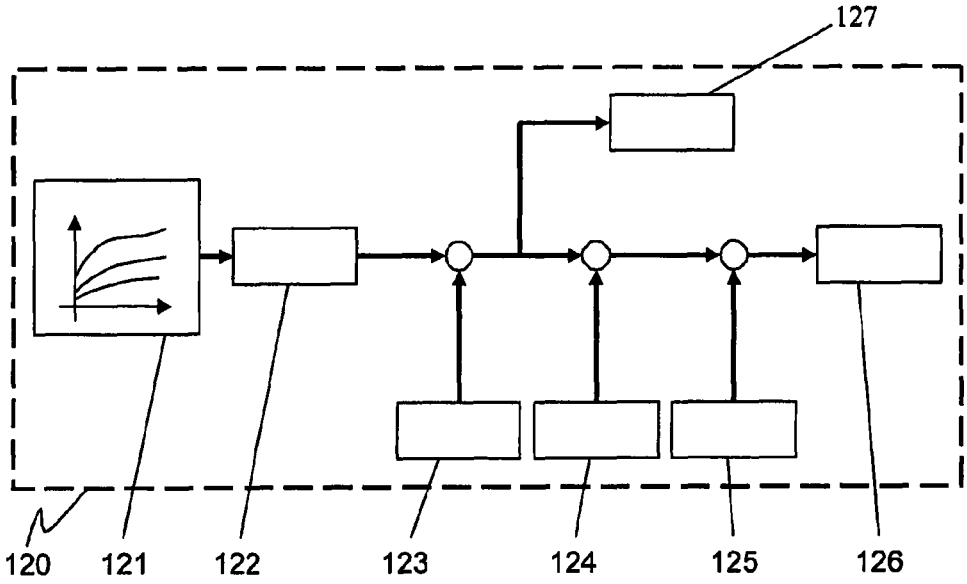

The invention is explained in detail using the examples of embodiment depicted in the figures. The following items are shown:

FIG. 1 a schematic depiction of an internal combustion engine with an exhaust gas aftertreatment system as the application example of the procedure, FIG. 2 a schematic depiction of the $SO_x$ removal calculation.

FIG. 1 shows as an example a technical layout, in which the procedure according to the invention is operating. In the Figure an internal combustion engine 1 consisting of an engine block 40 and an incoming air duct 10, which supplies the engine block 40 with combustible air, is depicted, whereby the amount of air in the incoming air duct 10 can be determined using an incoming air measurement mechanism 20. The exhaust gas of the internal combustion engine 1 is thereby carried by way of an emission control system, which has in the example shown an exhaust gas duct 50 as its main component. A particle filter 70 (DPF) and subsequently a $NO_x$ storage catalytic converter 90 are disposed in the exhaust gas duct 50 in the direction of flow. Provision is additionally made for a fuel metering mechanism 30 in the form of a diesel injection system, which is controlled, respectively actuated, in a closed-loop by way of an engine control unit 110.

The closed-loop control of a work mode of the internal combustion engine 1 can result on the basis of selected operating parameters. It is, for example, therefore conceivable by means of Lambda probes 60 and/or $NO_x$ sensors 100 disposed in the exhaust gas duct 50 to determine the composition of the exhaust gas. Additionally an exhaust gas temperature can, for example, in the area of the emission control system, for example between the particle filter 70 and the $NO_x$ storage catalytic converter 90, be determined using one or several temperature probes 80. From the signals of the various probes 60, 80, 100, which are connected to the engine control unit 110, as well as from the data acquired by the incoming air measurement mechanism 20, the mixture can be calculated and the fuel metering mechanism 30 can be accordingly actuated to meter the fuel. Provision is thereby made according to the invention for a $SO_x$ removal calculation 120 to be implemented as software in the engine control unit 110.

The discharge of sulfur during a desulfurization process ($DeSO_x$ process), which is necessary for the regeneration of the $NO_x$ storage catalytic converter 90, is essentially dependent on

- the composition of the reducing agent in the rich fuel mixture,
- the temperature of the $NO_x$ storage catalytic converter 90,
- the exhaust gas mass flow,
- the entire amount of sulfur embedded and
- the progress of the process, whereby during the desulfurization process all of these parameters are constantly changing.

A suitable removal model deals with the sulfur discharge as a function of the conditions, as it is schematically depicted in a flow diagram in FIG. 2.

Provision is made in the procedure according to the invention for conditions, in which a reducing agent flow 122 in the exhaust gas is generated, to be adjusted in the exhaust gas for the sulfur removal. In so doing, a $SO_x$ removal amount 126 can be determined from a reducing agent flow 122 and from additional operating parameters of the internal combustion engine 1 derived from a model, whereby the reducing agent flow 122 in the exhaust gas during the sulfur removal is determined from a reducing agent characteristic diagram 121. This characteristic diagram 121 is constructed from the operating state, from a rotational speed and from a torque of the internal combustion engine 1.

Provision is made in a correction step for the reducing agent flow 122 to be corrected with a Lambda correction 123, which is calculated from a deviation from a set point Lambda value, which is calculated for the desulfurization from an actual Lambda value. In this desulfurization phase, a significant discharge of the sulfur out of the $NO_x$ storage catalytic converter 90 as a result of the short richening of the exhaust gas ($\lambda<1$) can be observed. For that reason, the Lambda correction 123 takes into account a Lambda deviation from the set point Lambda value, which occurs, if especially during the dynamic operation, the desired Lambda value is not achieved; and the reducing agent flow 122 consequently deviates from the ideal exhaust gas composition.

Provision is made in a procedural variation for the reducing agent flow 122 corrected by the Lambda correction 123 to be integrated; and when a specifiable reducing agent threshold value 127 is achieved, for the operating conditions generating the reducing agent flow in the exhaust gas to be terminated after a specifiable time, i.e. the rich operation is terminated before a release of hydrogen sulfide ($H_2S$).

Provision is made in an additional step for the reducing agent flow 122 to be corrected with a temperature correction 124, which is calculated from the temperature of the $NO_x$ storage catalytic converter 90. In addition it is advantageous if the temperature probe 80 is thermally connected to the $NO_x$ storage catalytic converter 90. This temperature correction 124 can be determined, in that the desulfurization is implemented repeatedly at different temperatures and the effect is compared.

Provision is made in the procedure according to the invention in a third step for the reducing agent flow 122 to be corrected with a $DeSO_x$ progression correction 125 concerning the desulfurization process. The $DeSO_x$ progression correction 125 is calculated proportionally from the time duration of the desulfurization, whereby the penetrating properties of the reducing agent flow 122 into the $NO_x$ storage catalytic converter are depicted. These properties constantly change with the passage of time.

With the procedure described for the $SO_x$ removal calculation 120, dynamic effects during a desulfurization of the $NO_x$ storage catalytic converter can be better taken into account; and in so doing, the subsequent effect of the $NO_x$ storage catalytic converter 90 on the reduction of the nitrogen oxides in the exhaust gas can be better predicted, which makes the process management more streamlined and thereby more fuel efficient.

The invention claimed is:

1. A method of determining sulfur removal of a $NO_x$ catalytic converter in an exhaust gas aftertreatment system of an internal combustion engine, the method comprising:

adjusting conditions in which a reducing agent surplus is generated for the sulfur removal; and determining an $SO_x$ removal amount in an $SO_x$ removal calculation using a model from a reducing agent flow and from additional operational parameters of the internal combustion engine, wherein the reducing agent flow is determined during sulfur removal from a reducing agent characteristic diagram that is constructed from an operating state, a rotational speed, and a torque of the internal combustion engine, wherein the reducing agent flow is corrected with a Lambda correction calculated from a deviation from a set point Lambda value and an actual Lambda value, and wherein the corrected reducing agent flow is integrated and when a specifiable reducing agent threshold value is achieved, the operating conditions for the generation of the reducing agent flow in the exhaust gas are terminated according to a specifiable time.

2. A method according to claim 1, wherein the reducing agent flow is corrected with a temperature correction, which is calculated from the temperature of the $NO_x$ storage catalytic converter.

3. A method according to claim 2, wherein the temperature correction is determined, in that the desulferization is implemented repeatedly at different temperatures, and the effect is compared.

4. A method according to claim 1, wherein the reducing agent flow is corrected with a $DeSO_x$ progression correction, which is proportionally calculated from a time duration of the desulferization.

5. A method according to claim 1, wherein the $SO_x$ removal calculation is implemented as software in an engine control unit.

* * * * *